US009518415B2

(12) United States Patent
Hsieh

(10) Patent No.: US 9,518,415 B2
(45) Date of Patent: Dec. 13, 2016

(54) UNIDIRECTIONAL CENTRIFUGAL MECHANISM OF DOOR OPERATOR

(71) Applicant: Chung-Hsien Hsieh, New Taipei (TW)

(72) Inventor: Chung-Hsien Hsieh, New Taipei (TW)

( * ) Notice: Subject to any disclaimer, the term of this patent is extended or adjusted under 35 U.S.C. 154(b) by 51 days.

(21) Appl. No.: 14/512,549

(22) Filed: Oct. 13, 2014

(65) Prior Publication Data

US 2015/0101147 A1 Apr. 16, 2015

(30) Foreign Application Priority Data

Oct. 14, 2013 (TW) ..... 102136904 A

(51) Int. Cl.

| | |
|---|---|
| ***E06B 9/90*** | (2006.01) |
| ***E05F 5/00*** | (2006.01) |
| ***E05F 5/04*** | (2006.01) |
| ***E05F 3/16*** | (2006.01) |

(52) U.S. Cl.

CPC .. *E05F 3/16* (2013.01); *E05F 5/04* (2013.01); *E06B 9/90* (2013.01); *Y10T 16/293* (2015.01)

(58) Field of Classification Search

CPC ..... E05F 3/16; E05F 15/20; E05F 5/00; E05F 5/02; E05F 5/04; E05F 2005/043; E05F 3/00; E06B 9/56; E06B 9/90; A62C 2/24

USPC ..... 16/64, 49; 49/322; 160/8, 296

See application file for complete search history.

(56) References Cited

U.S. PATENT DOCUMENTS 1,268,914 A * 6/1918 Barry et al. ..... E06B 9/82 160/296
1,353,219 A * 9/1920 Collins ..... E05F 3/16 16/64
1,873,650 A * 8/1932 Kuhl ..... E05F 3/16 16/64
3,795,075 A * 3/1974 Orzechowski ..... G07F 17/145 188/82.2
3,897,651 A * 8/1975 Sheckells ..... E05D 15/02 49/43
3,998,008 A * 12/1976 Collins ..... G07F 17/14 49/47

(Continued)

FOREIGN PATENT DOCUMENTS

| | | |
|---|---|---|
| TW | 368033 | 8/1999 |
| TW | I342931 | 6/2011 |
| TW | 201305426 A | 2/2013 |

OTHER PUBLICATIONS

Search Report 10420325580, Mar. 13, 2015, TW.
Office Action 10420325580, Mar. 13, 2015, TW.

*Primary Examiner* — Emily Morgan

(74) *Attorney, Agent, or Firm* — Bui Garcia-Zamor; Jessica H. Bui, Esq.

(57) ABSTRACT

A rolling door operator comprises a rotary shaft, a centrifugal brake mechanism, and a unidirectional centrifugal mechanism, in which a latching tooth and plurality of slots are disposed around one end of the rotary shaft, and the unidirectional centrifugal mechanism includes an active pin with an axial latching face and a sliding face, the axial latching face being engaged with one of slots to latch the rotary shaft together only in the falling direction of a door curtain, and the sliding face having a bevel adjacent to the latching face to contact slidingly over the slots, so that the door curtain can be lifted up immediately in another direction, and without affecting normal opening function of the door curtain.

6 Claims, 4 Drawing Sheets

(56) References Cited

U.S. PATENT DOCUMENTS 4,188,992 A * 2/1980 Segerljung ..... E06B 9/82 160/296
4,325,164 A * 4/1982 Sasaki ..... E05F 3/08 16/52
5,048,151 A * 9/1991 Orii ..... E05F 3/00 16/49
5,146,711 A * 9/1992 Gallenschutz ..... E06B 11/08 49/35
5,203,392 A * 4/1993 Shea ..... A62C 2/242 160/133
5,355,927 A * 10/1994 McKeon ..... A62C 2/24 160/133
5,386,891 A 2/1995 Shea ..... 188/171
5,607,030 A * 3/1997 Swift ..... B60B 33/00 16/35 R
5,673,514 A * 10/1997 McKeon ..... A62C 2/24 49/30
5,743,320 A * 4/1998 McKeon ..... E06B 9/82 160/291
5,971,055 A * 10/1999 Rohaut ..... E06B 9/84 160/300
6,189,181 B1 * 2/2001 Bissett ..... E05F 5/00 16/77
7,254,868 B2 * 8/2007 Mullet ..... E05D 13/003 16/198
7,600,553 B2 * 10/2009 Bresson ..... E05D 13/1269 160/301
2002/0046815 A1 * 4/2002 Taniguchi ..... E06B 9/84 160/8
2007/0204515 A1 * 9/2007 Barriault ..... E05D 13/003 49/322
2008/0134582 A1 * 6/2008 Kraeutler ..... E06B 9/84 49/322
2009/0000201 A1 * 1/2009 Fahl ..... E05F 15/622 49/280
2009/0107051 A1 * 4/2009 Talpe ..... E05F 15/619 49/386
2012/0024484 A1 * 2/2012 Hsieh ..... A62C 2/24 160/291
2014/0060754 A1 * 3/2014 Hsieh ..... A62C 3/14 160/7
2015/0211279 A1 * 7/2015 Suzuki ..... H02K 7/10 16/65

* cited by examiner

UNIDIRECTIONAL CENTRIFUGAL MECHANISM OF DOOR OPERATOR

BACKGROUND OF THE INVENTION

Field of the Invention

The invention relates to a unidirectional centrifugal mechanism, and particularly, to a unidirectional centrifugal mechanism of a door operator for a fireproof rolling door, making the rolling door having the functions of fireproof, smoke prevention, and escape.

Description of the Related Art

For a general fireproof and smoke prevention rolling door driven vertically or horizontally, a door curtain of slats slides down to close a door with its own weight, so as to effectively block smoke or flame generated during a fire accident. It can be understood that the weight of a rolling door curtain, especially, a large-sized rolling door curtain, is quite heavy, and hence in case it loses control in speed, its dropping due to acceleration of gravity, must cause a destructive power.

As such, an industry manufacturer is always demanded of a strict design for safety, to guarantee that, no matter the door curtain rises or falls, any dangers caused by human factors or machine factors should not happen. Accordingly, a door operator for a general fireproof rolling door is basically provided with a "centrifugal brake mechanism". Thus, when a fire accident occurs and the door curtain slides down automatically to close the door by its own weight, the falling speed of the rolling door for fireproof and smoke prevention is controlled within a predetermined safety range.

For an emergency exit rolling door and an escape rolling door, they are exactly opposite to each other in structure according to their different functions and purposes. However, In case of a fire accident, they must be kept unblocked and easily opened. Therefore, for a manufacturer, many different controlling types of door operators must be developed in order to response to the requirements for different installation sites, functions and purposes. Accordingly, not only development time is long and cost for the development is high, but also the number of parts is large, which renders production complicated, and inventory cost relatively increased.

It is known that many documents are related to door operators for fireproof rolling doors. For example, U.S. Pat. No. 5,203,392 and U.S. Pat. No. 5,386,891 are proposed. For the disclosure of the above-mentioned patent publications, in the case of no braking during a power outage, the door curtain of slats slides down to close up door by its own weight so as to effectively block smoke or flame generated by a fire accident. On the other hand, if the door curtain of slats must be opened in an emergency for an escape during a fire accident, although the door curtain of slats can be driven to move up by a manual pull-chain mechanism, it takes a lot of time and consumes much more physical strength, and causing a late escape.

Although the manual pull-chain mechanism is used to open the door curtain of slats, a person having ordinary skills in the art is ready to understand that the centrifugal brake mechanism of a traditional door curtain of slats can not only be used to retard the falling speed of the fireproof rolling door or the smoke prevention rolling door, but also can retard the rolling door opening, which resulting in a late door opening.

The inventor thinks that if a centrifugal brake mechanism of door operator retards the falling speed of the door curtain of slats only in one directions but doesn't effect normal opening thereof in the other direction in spite of the case of emergency, then the door operator can be used for the purposes of fireproof, smoke prevention, and escape all together, that is to say, the structure of the door operator and its production are simplified to relatively reduce development and inventory costs thereof.

SUMMARY OF THE INVENTION

The main objective of the present invention is to provide a unidirectional centrifugal mechanism of a manual door operator for a fireproof and smoke prevention rolling door, wherein when a door curtain slides down to close by its own weight during a fire accident, the falling speed of the door curtain can be unidirectionally retarded within a predetermined safety range by a centrifugal brake mechanism.

Another objective of the present invention is to provide an unidirectional centrifugal mechanism of a manual door operator for a fireproof and smoke prevention door, wherein when a door curtain is closed during a fire accident, the door curtain can be lifted fast to open to escape.

Still another objective of the prevention is to provide an unidirectional centrifugal mechanism of a manual door operator for a fireproof and smoke prevention door, wherein the door operator has the functions of fireproof, smoke prevention, and escape, and thereby the structure of the door operator and its production are simplified, to relatively reduce development and inventory costs thereof.

In order to obtain the above-mentioned objectives and other objectives, an unidirectional centrifugal mechanism of a manual door operator for a fireproof and smoke prevention door according to the prevent invention is provided. The door operator comprises a rotary shaft, a centrifugal brake mechanism, and an unidirectional centrifugal mechanism, wherein the rotary shaft is provided in a housing, a plurality of slots equally spaced from each other are disposed circumferentially on a first end of the rotary shaft, and a second end of the rotary shaft is coupled to an output shaft; the centrifugal brake mechanism includes an end disc, a pair of stationary pins, and a pair of brake pads, wherein the end disc is rotatably mounted on the first end of the rotary shaft, and a shaft hub having a radial mounting hole extends from one end face of the end disc toward the plurality of slots; the pair of stationary pins is disposed on the other end face of the end disc; each of the pair of brake pads has a first end pivoted on one of the pair of stationary pins, and a second end, which is free to swing to urge against an inner wall of the housing when it subjects to a centrifugal force so as to retard the rotating speed of the rotary shaft; the unidirectional centrifugal mechanism includes an active pin, having a unidirectional latching tooth at one end thereof, the active pin being inserted into the mounting hole, the active pin being biased by an elastic element, so that the latching tooth is biased toward the plurality of slots.

According to the unidirectional centrifugal mechanism of the present invention, a base is further included, the base being disposed on the shaft hub and located outside the mounting hole, wherein one end of the active pin is slidably mounted in the mounting hole, and the other end of the active pin extends through the base, with a effect that the elastic element is accommodated in the mounting hole to be compressed and configured to surround the active pin, and is located between the latching tooth and base to make the latching tooth slide toward the plurality of slots constantly.

The latching tooth of the active pin has an axial latching face and a radial sliding face adjacent to the latching face; the plurality of slots of the rotary shaft each includes two oppositely facing slot walls, wherein when one of the two slot walls urges against the latching face, the end disc is driven, and when the other of the two slot walls urges against the sliding face, the end disc is not driven.

Furthermore, the active pin further comprises a draw bar at one other end thereof, and the base includes a limiting slot for receiving the draw bar, so that the heading direction of the latching tooth can be changed, when the draw bar is lifted to disengage from the limiting slot.

Accordingly, with the unidirectional centrifugal mechanism, the centrifugal brake mechanism of the door operator will retard the falling speed of the door curtain only in unidirection, and the door curtain is free to be reversely lifted up to open. That is, the door curtain has the functions of fireproof, smoke prevention, and escape all together, which makes the structure of the door curtain and its production be simplified, and development and inventory costs thereof is relatively reduced.

DESCRIPTION OF THE PREFERRED EMBODIMENTS

Figure 1:
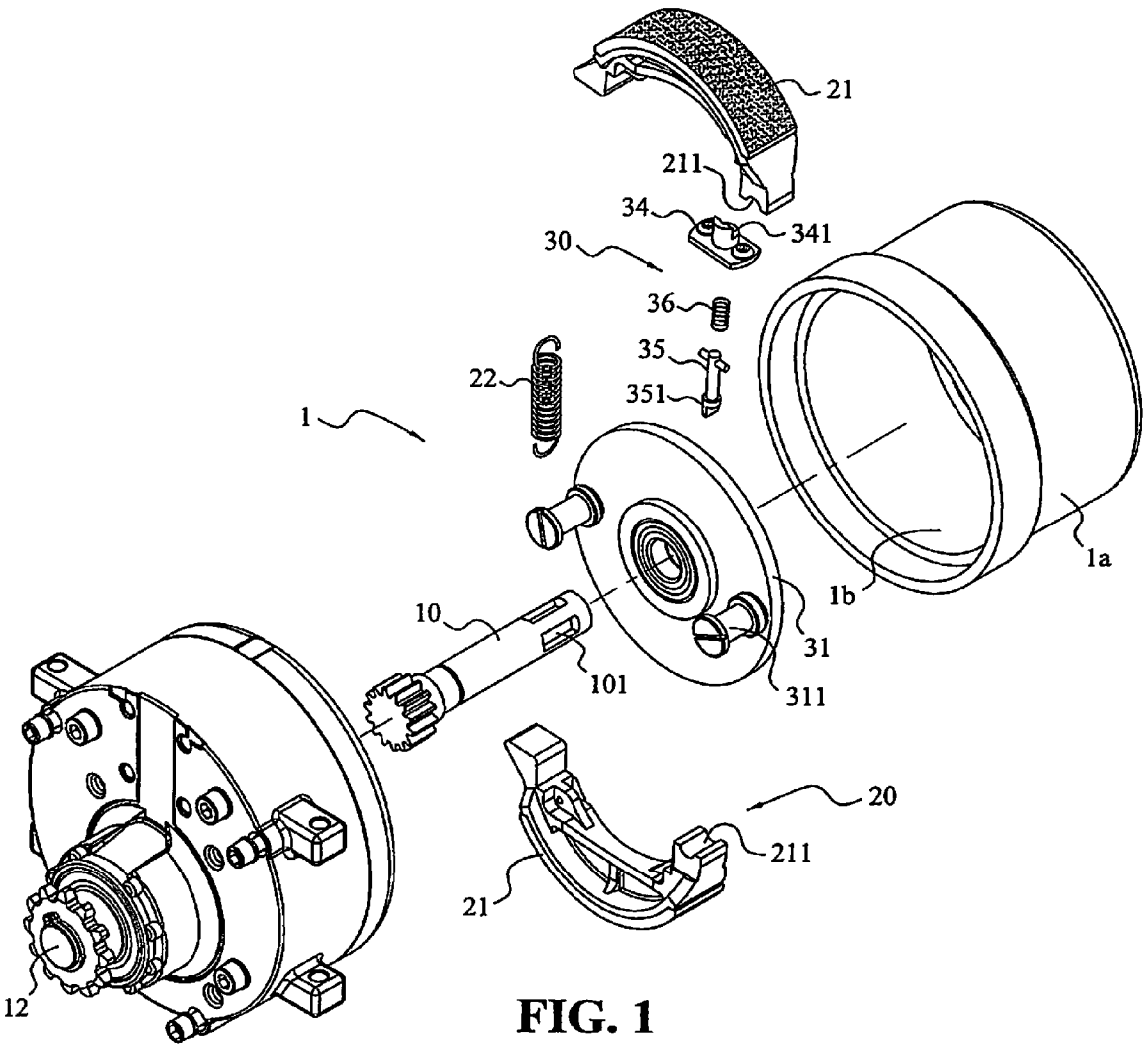
FIG. 1 is an exploded perspective view showing an unidirectional centrifugal mechanism of a door operator of the present invention.
Figure 2:
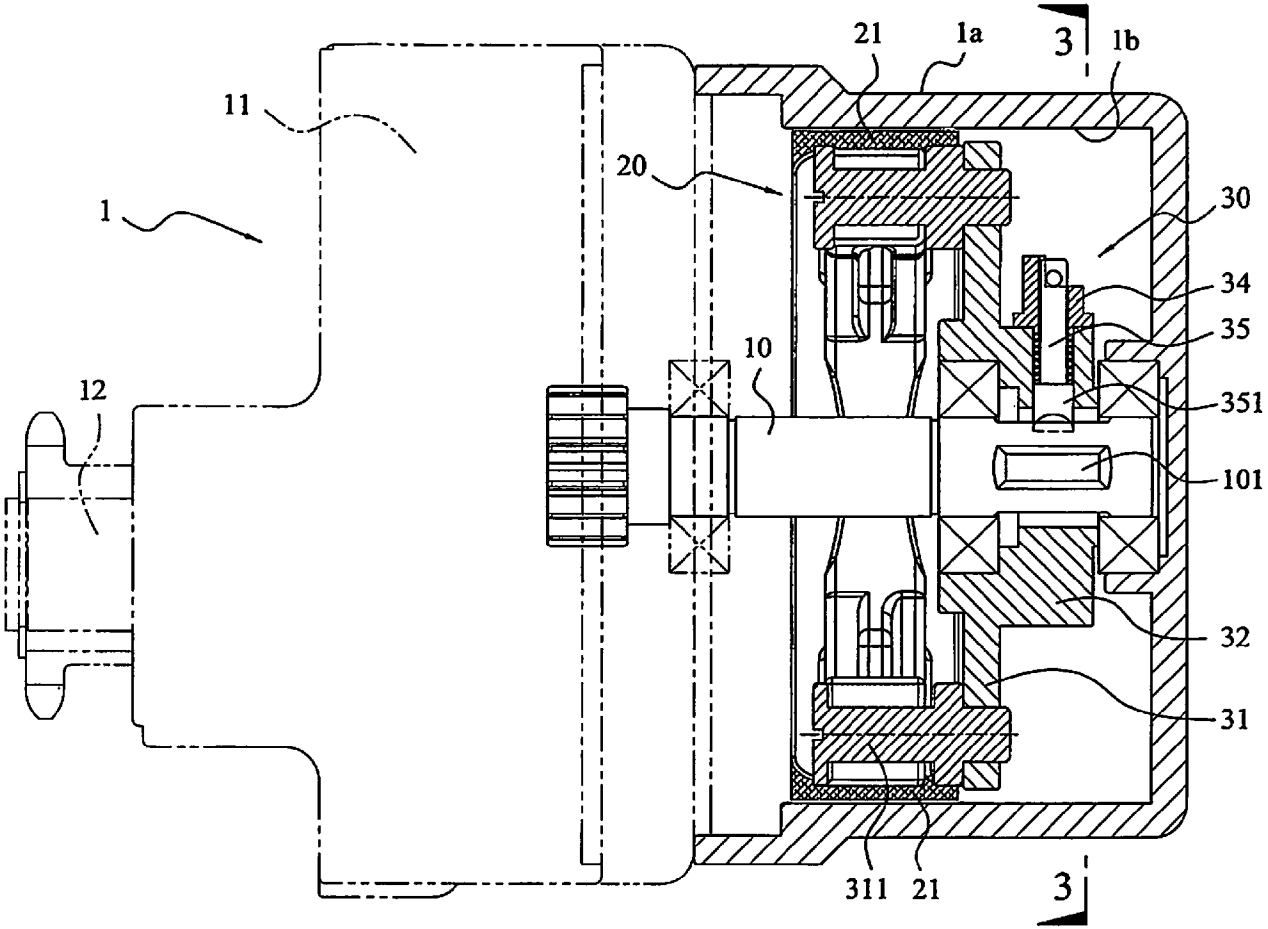
FIG. 2 is a schematic cross-sectional view showing the unidirectional centrifugal mechanism of the door operator of FIG. 1 to be in an assembled state.
Figure 3:
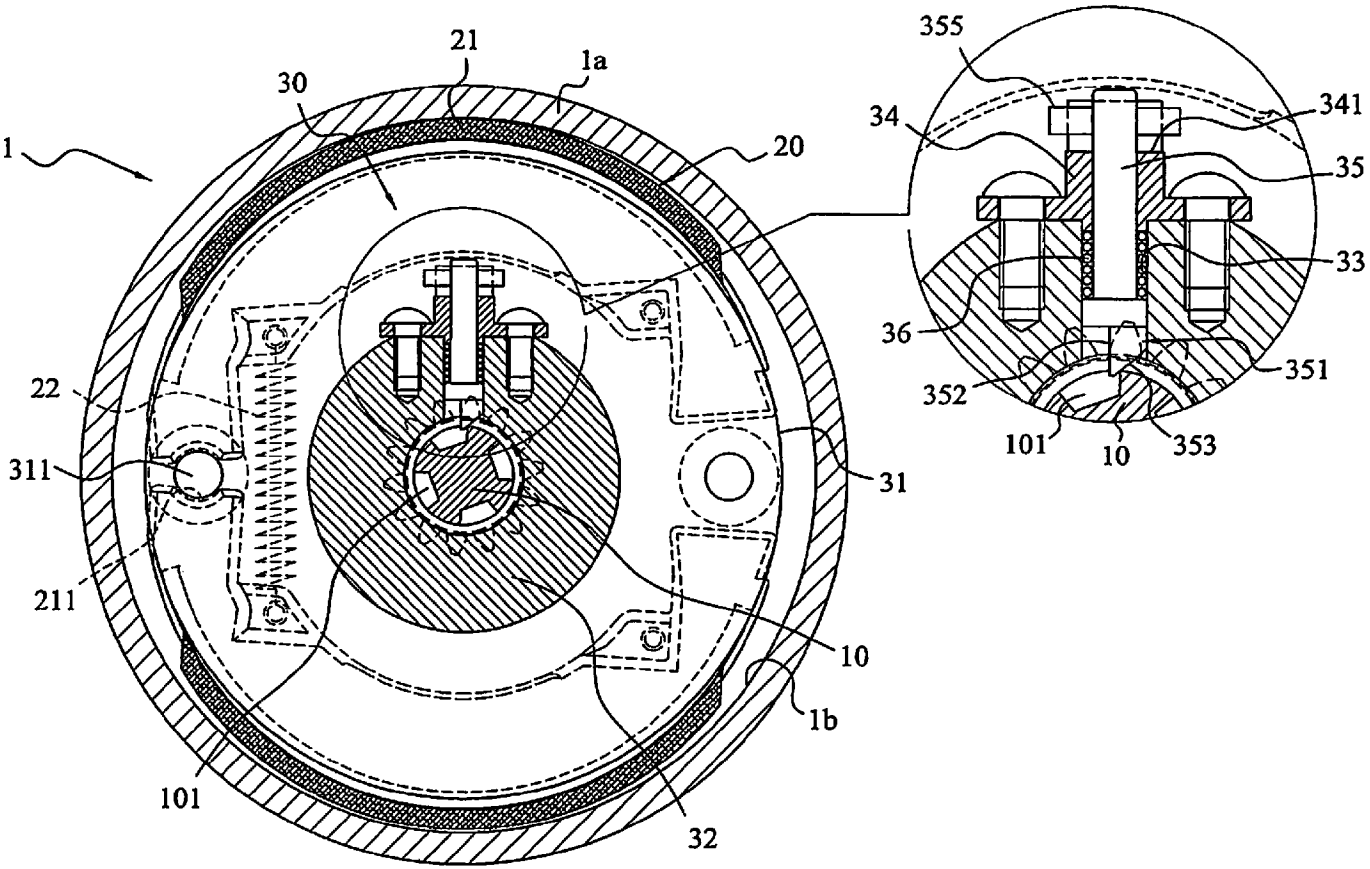
FIG. 3 is a schematic cross-sectional view taken along line 3-3 of FIG. 2.

First, a preferred embodiment of a unidirectional centrifugal mechanism of a door operator of the present invention is described with reference to FIGS. 1 to 3. In the embodiment, the door operator is used, for example, for a small-sized manual fireproof and smoke prevention rolling door. As shown in the drawings, the door operator 1 basically comprises a rotary shaft 10, a centrifugal brake mechanism 20, and a unidirectional centrifugal mechanism 30. The rotary shaft 10 is borne by a housing 1*a*. A plurality of slots 101 equally spaced from each other are disposed circumferentially on a first end of the rotary shaft 10, and a second end of the rotary shaft 10 is coupled to an output shaft 12 via a reduction mechanism (not shown in FIGS. 1 to 3).

The centrifugal brake mechanism 20 comprises an end disc 31, a pair of stationary pins 311, and a pair of brake pads 21, in which the end disc 31 is rotatably fitted on the first end of the rotary shaft 10, and a shaft hub 32 is provided on the right end face of the end disc 31 to surround the plurality of slots 101, the shaft hub 32 having a radialy-through mounting hole 33. The pair of stationary pins 311 is disposed on the left end face of the end disc 31 opposite to each other. The pair of brake pads 21 is configured to surround the rotary shaft 10 between the first end and second end of the rotary shaft 10. First ends of the brake pads 21 are formed with semi-pivoting rests 211 respectively, and are pivoted on one of the stationary pins 311 with an elastic element 22 holding the brake pads 21 together. The second ends of the brake pads 21 are free to swing to urge against an inner wall 1*b* of the housing 1*a* when they subject to centrifugal force (as shown in FIGS. 2 and 3).

The unidirectional centrifugal mechanism 30 comprises a base 34, an active pin 35, and an elastic element 36. The base 34 is located outside the mounting hole 33 and disposed on the shaft hub 32. The active pin 35 is inserted into and slidably mounted within the mounting hole 33. The front end of the active pin 35 is provided with a latching tooth 351, and the rear end of the active pin 35 extends out of the base 34. An elastic element 36 is accommodated in the mounting hole 33 and is located and compressed between the latching tooth 351 and base 34 so as to urge the active pin 35, such that the latching tooth 351 is biased toward the slots 101.

The latching tooth 351 of the active pin 35 has an axial latching face 352 in a vertical direction and a radial sliding face 353 with a bevel adjacent to the latching face 352. Additionally, the active pin 35 is provided with a draw bar at the rear end thereof, and the base 34 is sloted with a horizontal limiting slot 341 for receiving the draw bar, and hence, the heading direction of the latching tooth 351 can be changed when the draw bar is lifted up to release its disengagement with the 101.

Figure 4:
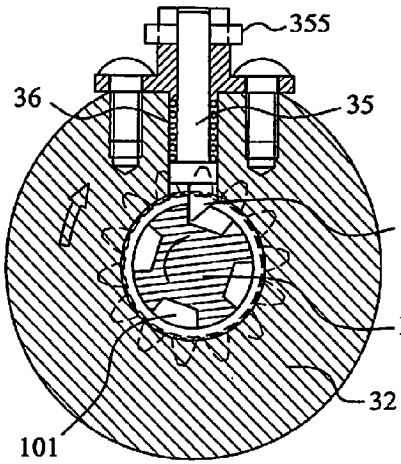
FIG. 4 is a partially enlarged view showing the unidirectional centrifugal mechanism of FIG. 3 with other mechanisms already to be driven by a rotary shaft, in which the other mechanisms, which is irrelevant to description, is omitted.

As shown in FIG. 4, when the rotary shaft 10 rotates clockwise, a forward slot wall of the slot 101 will engage with the latching face 352 of the latching tooth 351 to drive the end disc 31, i.e., the centrifugal brake mechanism 20 is rotated accordingly. At this point, the free ends of the brake pads 21 swings outwards around the pin to press against the inner wall 1*b* of the housing 1*a* under an induced centrifugal force action. Hence, a friction occurs to retard the speed of rotation of the rotary shaft 10 within a predetermined safety range.

On the contrary, as shown in FIG. 4, when the rotary shaft 10 rotates counterclockwise, a backward slot wall of the slot 101 will contact with the sliding face 353 of the latching tooth 351 and push the sliding face 353 along the bevel thereof to lift up. At this point, the rotary shaft 10 rotates solely, and the end disc 31 is not driven, i.e., the centrifugal force is not exerted on the brake pads 21 of the centrifugal brake mechanism 20.

Figure 5:
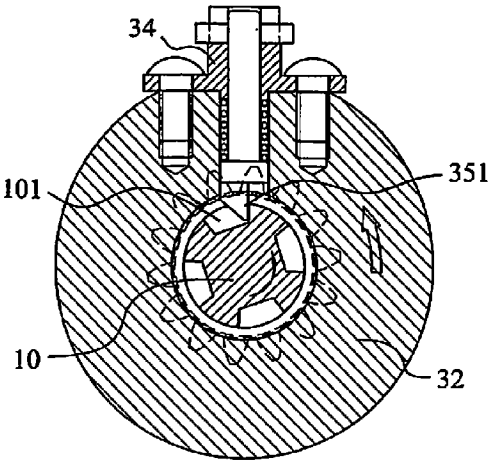
FIG. 5 is a schematic view showing the unidirectional centrifugal mechanism of FIG. 4 to be driven by the rotary shaft in a reverse direction to that of FIG. 4.
Figure 4A:
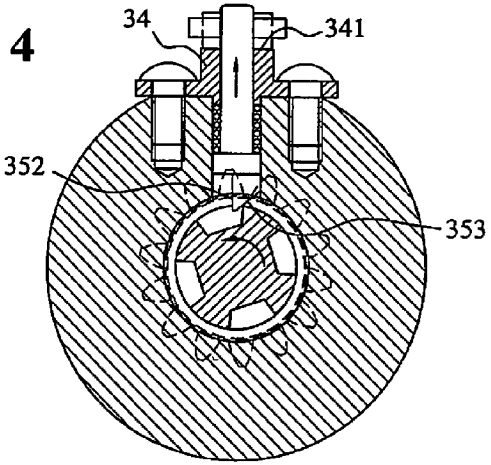
FIG. 4*a* is a schematic view showing the unidirectional centrifugal mechanism of FIG. 4 to be not driven by the rotary shaft in a reverse direction to that of FIG. 4.
Figure 5A:
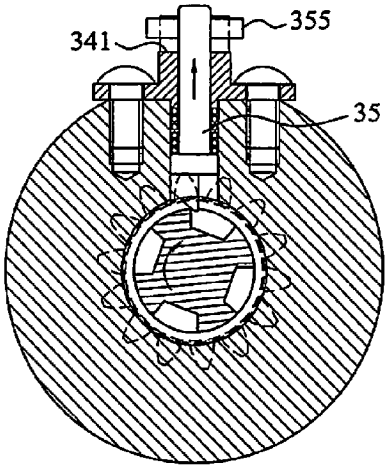
FIG. 5*a* is a schematic view showing the unidirectional centrifugal mechanism of FIG. 5 to be not driven by the rotary shaft.

Moreover, as shown in FIGS. 5 and 5*a*, the active pin 35 can be lifted from its still position by pulling up the draw bar 355. After the active pin 35 is lifted up and disengaged with the limiting slot 341, the heading direction of the latching tooth 351 can be selectively changed by turning the active pin 35, and then release the draw bar 355. At this point, when the rotary shaft 10 rotates counterclockwise, its speed of rotation is retarded by the brake pads 21 of the centrifugal brake mechanism 20, but when the rotary shaft 10 rotates clockwise, it can rotate freely, which is like the operations of FIGS. 4 and 4*a* but in inverted sequence.

Accordingly, with the unidirectional centrifugal mechanism, the centrifugal brake mechanism of the door operator can retard the falling speed of the curtain of the door slats only in one direction, but lets the curtain of the door slats alone for it to be easily lifted by manual operation in the other direction without effecting normal opening in spite of the case of emergency, so as to make the door curtain have the functions of fireproof, smoke prevention, and escape all together, which makes the structure of the door operator and its production be simplified to relatively reduce development and inventory costs thereof.

The above embodiment of the present invention is a explanatory example only, and the present invention is not limited to the details disclosed in the drawings and specification. Persons having ordinary skills in the art can make various changes, which should fall within the scope of the present invention, without departing from the scope of the claims.

What is claimed is:

1. A door operator, comprising a rotary shaft, a centrifugal brake mechanism, and a unidirectional mechanism, wherein:

the rotary shaft is provided in a housing, a plurality of slots equally spaced from each other are disposed circumferentially on a first end of the rotary shaft, and a second end of the rotary shaft is coupled to an output shaft;

the centrifugal brake mechanism includes an end disc, a pair of stationary pins, and a pair of brake pads, the end disc is rotatably mounted on the first end of the rotary shaft, the end disc has a first end face and a second end face opposite to the first end face, a shaft hub extends from the first end face of the end disc and has a radial mounting hole extending radially toward the plurality of slots; the pair of stationary pins extend from the second end face of the end disc; the pair of brake pads are pivoted on the end disc by the pair of stationary pins, respectively, so that each of the pair of brake pads is capable of being swung and abutted on an inner wall of the housing when the centrifugal brake mechanism is rotated together with the rotary shaft;

the unidirectional mechanism includes a base, an active pin and an elastic element, the base is disposed on the shaft hub and located outside the mounting hole, the base includes a limiting slot; one end of the active pin is provided with a unidirectional latching tooth, the active pin is slidably disposed in the mounting hole in such a manner that the other end of the active pin extends through the base and protrudes from the base; the other end of the active pin is provided with a draw bar; the elastic element is accommodated in the mounting hole and configured to surround the active pin; the elastic element is compressed and located between the unidirectional latching tooth and the base so that the active pin is biased by the elastic element and that the latching tooth is biased toward the plurality of slots when the draw bar is received in the limiting slot.

2. The door operator as claimed in claim 1, wherein the latching tooth of the active pin has an axial latching face and a radial sliding face adjacent to the latching face; each of the plurality of slots of the rotary shaft includes two oppositely facing slot walls, when one of the two slot walls urges against the latching face, the end disc is driven, but when the other of the two slot walls urges against the sliding face, the end disc is not driven.

3. The door operator as claimed in claim 1, wherein a heading direction of the latching tooth is changeable when the draw bar is lifted and disengaged from the limiting slot.

4. A door operator for a fireproof and smoke prevention rolling door provided with a door curtain configured to slide down to close during a fire accident and to be lifted up to open by manual operation, the door operator comprising:

a rotary shaft provided in a housing, the rotary shaft including a plurality of slots equally spaced from each other and disposed circumferentially at a first end and an output shaft at a second end opposite of the first end of the rotary shaft;

a centrifugal brake mechanism arranged to retard the falling speed of the door curtain within a predetermined safety range, when the door curtain slides down to close in a unidirection; and a unidirectional mechanism arranged to control the falling speed of the door curtain only in a unidirection, wherein the centrifugal brake mechanism includes an end disc, a pair of stationary pins, and a pair of brake pads, the end disc is rotatably mounted on the first end of the rotary shaft, the end disc has a first end face and a second end face opposite to the first end face, a shaft hub extends from the first end face of the end disc and has a radial mounting hole extending radially toward the plurality of slots; the pair of stationary pins extend from the second end face of the end disc; the pair of brake pads are pivoted on the end disc by the pair of stationary pins, respectively, so that each of the pair of brake pads is capable of being swung and abutted on an inner wall of the housing when the centrifugal brake mechanism is rotated together with the rotary shaft;

wherein the unidirectional mechanism includes a base, an active pin and an elastic element, the base is disposed on the shaft hub and located outside the mounting hole, the base includes a limiting slot; one end of the active pin is provided with a unidirectional latching tooth, the active pin is slidably disposed in the mounting hole in such a manner that the other end of the active pin extends through the base and protrudes from the base; the other end of the active pin is provided with a draw bar; the elastic element is accommodated in the mounting hole and configured to surround the active pin; the elastic element is compressed and located between the unidirectional latching tooth and the base so that the active pin is biased by the elastic element and that the latching tooth is biased toward the plurality of slots when the draw bar is received in the limiting slot.

5. The door operator as claimed in claim 4, wherein the latching tooth of the active pin has an axial latching face and a radial sliding face adjacent to the latching face; each of the plurality of slots of the rotary shaft includes two oppositely facing slot walls, when one of the two slot walls urges against the latching face, the end disc is driven, but when the other of the two slot walls urges against the sliding face, the end disc is not driven.

6. The door operator as claimed in claim 4, wherein a heading direction of the latching tooth is changeable when the draw bar is lifted and disengaged from the limiting slot.

* * * * *